United States Patent [19]

Harvey et al.

[11] 4,446,082

[45] May 1, 1984

[54] METHOD OF VENEERING BRICK LININGS OF FURNACES AND OTHER HIGH TEMPERATURE ENCLOSURES

[75] Inventors: Barrie J. Harvey, Tyldesley; Ian J. Mann, Southport, both of England

[73] Assignee: M. H. Detrick Company, Limited, Lancashire, England

[21] Appl. No.: 347,273

[22] Filed: Feb. 9, 1982

[30] Foreign Application Priority Data

Feb. 9, 1981 [GB] United Kingdom ..... 8103862

[51] Int. Cl.[3] ..... C21B 7/06

[52] U.S. Cl. ..... 264/30

[58] Field of Search ..... 264/30

[56] References Cited

U.S. PATENT DOCUMENTS 4,120,641 10/1978 Miles ..... 264/30 X 4,244,761 1/1981 Remi ..... 264/30 X

*Primary Examiner*—Thomas P. Pavelko

*Attorney, Agent, or Firm*—Wenderoth, Lind & Ponack

[57] ABSTRACT

The brick lining of a furnace or other high temperature enclosure is veneered by adhesively securing to the brick lining 10 blocks 11 of ceramic fiber material that have been made by a vacuum casting process and have been pre-fired prior to installation. An undercut rabbet 13 may be provided along the periphery of the cold face of the blocks to provide an additional key between the adhesive and the blocks. A jointing layer 14 of a resilient ceramic fiber felt is disposed between the side faces of adjoining blocks.

8 Claims, 1 Drawing Figure

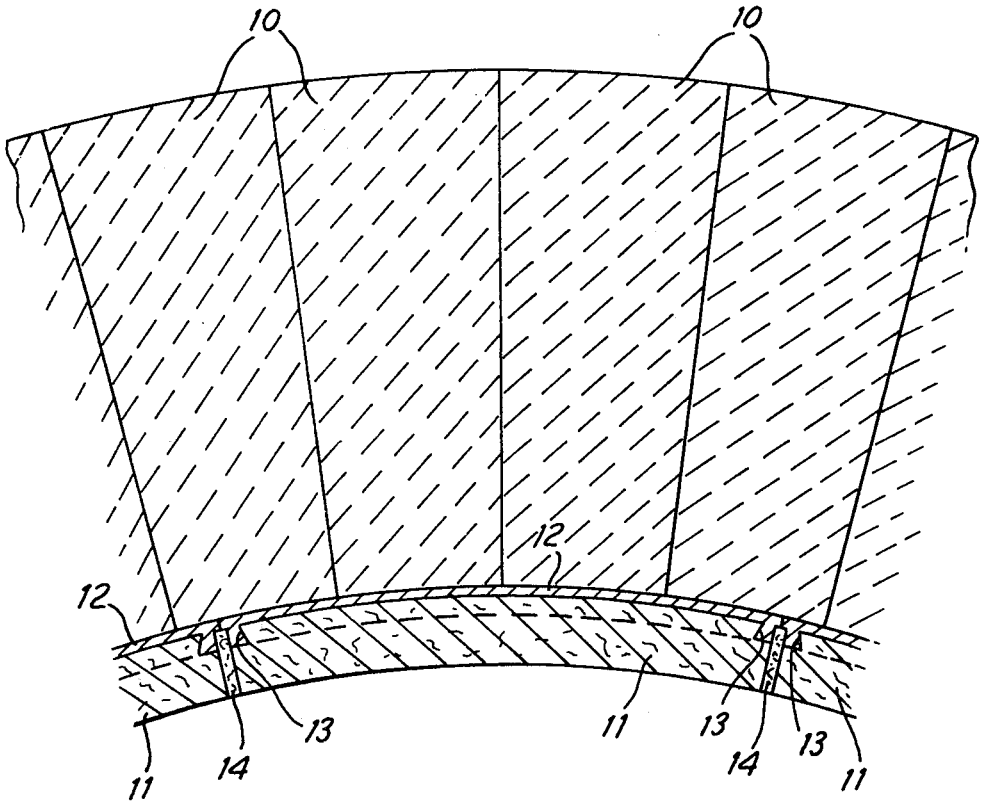
10
10
12
12
11
14
13
11
13
14
13
11

METHOD OF VENEERING BRICK LININGS OF FURNACES AND OTHER HIGH TEMPERATURE ENCLOSURES

This invention relates to furnaces or other high temperature enclosures and more particularly to the improvement of existing enclosures that have a lining of refractory bricks.

It has been proposed to secure on the hot face of a brick lining, a process which is known as veneering, a ceramic fibre material since such material has very good refractory properties and is an excellent thermal insulator. Ceramic fibre material in the form of blanket or board has been suggested for such application but both froms have disadvantages which make them unsuitable. In particular a blanket has no mechanical strength and presents a face which is easily abraded or eroded, while board although better in these respects has the great disadvantage that is suffers considerable distortion when first brought up to operating temperature, thus making it very difficult to fix securely in place. We have now found that these disadvantages can be overcome and that a satisfactory veneering of a brick lining with ceramic fibre material can be achieved.

According to the present invention there is provided a method of veneering a high temperature enclosure having a lining of refractory bricks, which method comprises the step of adhesively securing to the brick lining blocks of ceramic fibre material which have been made by a vacuum-casting process and which have been pre-fired prior to installation.

The expression vacuum casting as used herein refers to a process in which a quantity of an aqueous slurry containing ceramic fibres and appropriate binding agents is poured into a mould having a permeable base through which the water can drain, an operation which can be speeded up by the application of suction to the underside of the base. To ensure a product of uniform thickness the fibres while still wet may be subjected to a rolling operation in which a roller is supported at the required height by engagement of its ends with the sides of the mould, or the sides of a frame if the body of fibre has been removed from the mould.

A vacuum casting process is to be distinguished from a vacuum forming process, in which a mould is immersed in the slurry and suction is applied to the interior of the mould until a sufficient thickness of ceramic fibre has been built up in the mould, and has an important advantage over the latter process in that the product is of more uniform density and has a more random fibre orientation, both of which reduce the tendency to delamination and distortion at high temperature.

By pre-firing the vacuum cast ceramic fibre blocks to a temperature somewhat above the intended operating temperature it is possible to take out the irreversible permanent shrinkage which occurs in many ceramic fibre products when they are first heated to operating temperature. The pre-fired block then exhibits, at least up to its intended operating temperature only the normal reversible expansion and contraction with temperature which in practice is similar in magnitude to that of the brickwork to which the block will be adhered.

While any suitable adhesive may be used to secure these blocks to an existing brick lining we have found that a particularly suitable adhesive consists of a mixture of a commercially available refractory mastic and a commercially available refractory cement. Such an adhesive after firing has a coefficient of expansion similar to that of refractory bricks and the blocks, while its texture is a compromise between the hard bricks and the softer blocks.

The ceramic fibre blocks may be treated in various ways to improve the bond between them and the adhesive. For example the facing surface of the block, that is the cold face, may be roughened as for example by the use during the rolling operation of a roller having protruding spikes. It is also contemplated that the periphery of the block at the cold face could be formed with a rabbet having an undercut edge that enables the adhesive to act as a key to hold the block in position.

If desired the hot face of the pre-fired blocks may be coated with an acrylic copolymer to form a tough non-dusting skin.

In the application of this invention a fillet of a resilient ceramic fibre felt, such as that sold under the Trade Mark DEMEX, may be arranged between the facing edges of adjacent blocks.

The pre-fired ceramic fibre blocks may be manufactured in a few standard sizes and thicknesses, a typical block could be 30.5 cm square and 3.8 cm thick, while by providing some blocks shaped to a few standard curvatures almost any curved surface could be veneered, if necessary by mixing flat and curved blocks, special blocks for flue outlets, burner openings etc., may also be provided and a vacuum casting process is particularly suitable for use in making such special shapes.

The method is illustrated by way of example in the accompanying diagrammatic drawing which shows a sectional view of part of a wall of a furnace which has been veneered by a method in accordance with the invention.

The drawing shows part of the roof arch of a furnace lined with refractory bricks 10. The brick face of the roof is veneered with blocks 11 which are made from a ceramic fibre material by a vacuum casting process and which, prior to their attachment to the brickwork, have been pre-fired at a temperature in excess of the intended operating temperature of the furnace. The blocks are bonded to the face of the brickwork by means of an adhesive 12 comprising a mixture of 70 parts of a commercially available refractory mastic and 30 parts of a commercially available refractory cement. The cold face of the blocks may be roughened to provide an improved key for the adhesive, and the key may be further improved by the provision of an undercut rabbet 13 along the periphery of the cold face of the block. A layer of jointing material 14 in the form of a resilient ceramic fibre felt is disposed between the side faces of adjacent blocks.

We claim:

1. A method of veneering a high temperature enclosure having a lining of refractory bricks, which method comprises the step of adhesively securing to the brick lining of a high temperature enclosure, blocks of ceramic fiber material which have been made by a vacuum-casting process such that the fibers are randomly oriented, and which have been pre-fired prior to installation.

2. A method as claimed in claim 1, wherein the blocks are secured to the brick lining by an adhesive which is a mixture of a refractory mastic and a refractory cement.

3. A method as claimed in claim 1 or claim 2, wherein the blocks are secured to the brick lining by an adhesive which has a coefficient of expansion which is between the coefficient of expansion of the bricks and the coefficient of expansion of the pre-fired blocks.

4. A method as claimed in claim 1 or 2, wherein the hot face of the pre-fired blocks is coated with an acrylic copolymer forming a non-dusting skin on the blocks.

5. A method as claimed in claim 1 or 2, wherein a layer of a resilient ceramic fibre felt is disposed between the side faces of adjacent blocks.

6. A method as claimed in claim 1 or 2, wherein the surface of the blocks to which the adhesive is applied is treated to roughen it before application of the adhesive.

7. A method as claimed in claim 1 or 2, wherein the periphery of the cold face of each block is formed with a rabbet having an edge which undercuts said cold face.

8. A method as claimed in claim 2 in which the adhesive is a mixture of 70 parts of refractory mastic and 30 parts of refractory cement.

* * * * *